US007357588B2

(12) United States Patent
Liard

(10) Patent No.: US 7,357,588 B2
(45) Date of Patent: Apr. 15, 2008

(54) COSMETIC PRODUCT DISPENSER

(75) Inventor: Jerome Liard, St Jamme/Sarthe (FR)

(73) Assignee: Crown Packaging Technology, Inc., Alsip, IL (US)

( * ) Notice: Subject to any disclaimer, the term of this patent is extended or adjusted under 35 U.S.C. 154(b) by 124 days.

(21) Appl. No.: 11/304,158

(22) Filed: Dec. 15, 2005

(65) Prior Publication Data

US 2006/0131345 A1 Jun. 22, 2006

(30) Foreign Application Priority Data

Dec. 16, 2004 (FR) ..... 04 13439

(51) Int. Cl.
*B43K 21/08* (2006.01)
*B43K 21/00* (2006.01)

(52) U.S. Cl. ..... 401/76; 401/74; 401/80

(58) Field of Classification Search ..... 401/68, 401/74, 75, 76, 80, 171, 174; 222/386, 390
See application file for complete search history.

(56) References Cited

U.S. PATENT DOCUMENTS

| | | | | |
|---|---|---|---|---|
| 5,018,893 | A | 5/1991 | Holloway | 401/75 |
| 5,186,560 | A | 2/1993 | Holloway | 401/78 |
| 6,200,047 | B1 * | 3/2001 | Holloway | 401/75 |
| 6,827,213 | B2 * | 12/2004 | Hirotomi et al. | 206/385 |

* cited by examiner

*Primary Examiner*—David J. Walczak
(74) *Attorney, Agent, or Firm*—St. Onge Steward Johnson & Reens LLC

(57) ABSTRACT

A dispenser made of four molded polymeric pieces, a housing, an annular connector, an insert and an elevator. The dispenser has a slim profile that allows a twist-up dispensing of product having friction drag and suitable camming for an appealing movement of the parts and dispensing of product.

29 Claims, 4 Drawing Sheets

COSMETIC PRODUCT DISPENSER

PRIORITY CLAIM

I claim priority benefits under Title 35, United States Code, §119(a) of French Patent Application No. 0413439 filed 16 Dec. 2004, the disclosure of which is hereby incorporated by reference in its entirety.

FIELD OF THE INVENTION

The present invention relates to a stick dispenser used in packaging of cosmetic stick products such as lipstick.

BACKGROUND OF THE INVENTION

Stick dispensers for cosmetic stick products such as lipstick have in the past been used to dispense relatively large diameter cylindrical stick products having a diameter in the range of about 7/16 inches. Recently however, there has been a trend to slimmer stick products and dispensers with a more aesthetic profile. It would be desirable to be able to dispense products having a ¼ inch or less maximum diameter.

However, the construction of slimmer dispensers presents difficulties which differ from prior large diameter dispensers. In particular, the small diameter of such slimmer dispensers limits the available space for providing a twist-up elevator mechanism to move the stick product up and down in the dispenser barrel.

Slimmer dispensers also present difficulties for smooth operation of the dispenser. Providing friction drag or suitable camming for an appealing movement of the parts must overcome the restricted dimensions.

In addition, a slimmer product is more fragile than a larger diameter product, making it difficult to secure the product in the dispenser as it loses moisture and contracts.

SUMMARY OF THE INVENTION

Accordingly, it is an object of the invention to provide a slim profile dispenser that allows a twist-up dispensing of product.

It is also an object of the invention to provide a dispenser having friction drag and suitable camming for an appealing movement of the parts and dispensing of product.

It is yet another object of the invention to provide a dispenser which will secure the product to be dispensed within the dispenser even when the product loses moisture and contracts.

It is further an object of the invention to provide a dispenser which is economical and simple to assemble.

These and other aspects of the invention are achieved by provision of a dispenser having a longitudinally-extending housing having open upper and lower ends, and inner and outer walls, the lower end of the housing having a radially inwardly extending rib and the inner wall comprising a smooth surface. An annular connector has an inner wall and an outer wall and upper and lower ends. The upper end of the connector preferably has an annular channel formed in the outer wall such that the radially inwardly extending rib of the housing snap fits within the annular channel to secure the housing and connector together. Alternatively, the housing and the connector may be integrally molded together. The inner wall of the connector has radially inward extending shoulders at the upper end and lower end forming an inner recess therein.

It is preferable that the connector have at least two cantilevered tabs, each cantilevered tab formed by a C-shaped cut-out through the inner and outer walls of the connector. The cantilevered tabs may preferably have inwardly facing protrusions.

An internally screw threaded insert has an upper end with a radially outwardly extending rib sized to fit within the connector inner recess when the upper end is force fit within the connector such that the insert and the connector are rotatably connected. The cantilevered tabs may provide drag friction where the inwardly facing protrusions of the cantilevered tabs contact the radially outwardly extending rib of the insert when assembled.

An elevator has a platform adapted to slidingly fit inside the housing; the platform has an outer surface of generally the same cross-sectional shape of the inner wall of the housing. The elevator preferably includes a stem having a key adapted to be received in the internal screw threads of the insert. An opening in the upper end of the connector is sized to fit the key. The stem has a length sufficient to allow the elevator platform to be axially moved from a retracted position where the platform is generally adjacent the insert to an extended position where the platform is generally adjacent the upper open end of the housing. The feeling of a notched resistance to travel at the retracted and extended positions is provided to give the user the feel of locking the elevator in place in the retracted or extended positions. The notched resistance in the retracted position is caused by a protrusion at a lower end of the stem which engages with an edge of the opening in the upper end of the connector as the elevator enters and exits the retracted position. The notched resistance in the extended position is caused by a protrusion at an upper end of the stem. The protrusion engages an edge of the opening in the upper end of the connector as the elevator enters and exits the extended position.

The elevator preferably has a cylinder positioned on the elevator platform to contain the product to be dispensed. The cylinder may have ribs biased to extend inwardly at an angle not perpendicular from an inner surface of the cylinder such that the ribs are pressed against the bias by the insertion of the product to be dispensed to secure the product within the cylinder. The ribs may move with the bias to secure the product within the cylinder as the product contracts over time.

The objects of the invention are further achieved by provision of a dispenser having a longitudinally-extending housing comprising an upper housing portion and a lower connector portion. The upper housing portion may have an open upper end and inner and outer walls. The lower connector portion may have an inner wall and an outer wall and an upper end and an open lower end. The inner wall may have radially inward extending shoulders at the upper end and lower end forming an inner recess therein.

The invention and its particular features and advantages will become more apparent from the following detailed description considered with reference to the accompanying drawings.

DETAILED DESCRIPTION OF THE DRAWINGS

Figure 1:
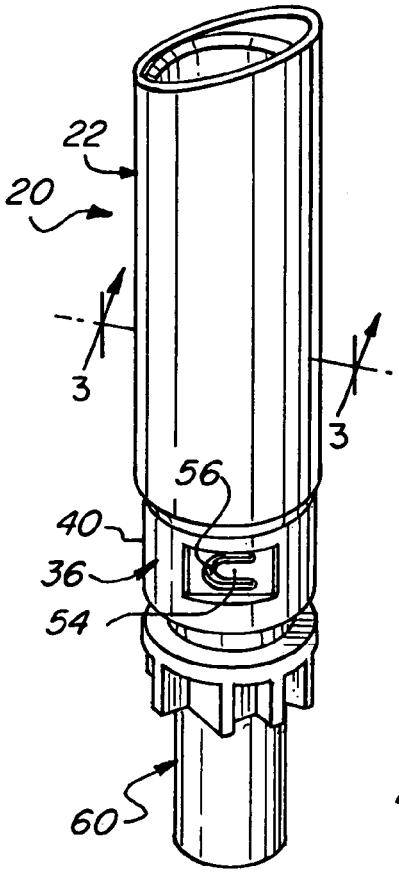
FIG. 1 is a perspective view of a dispenser in accordance with the invention.
Figure 2:
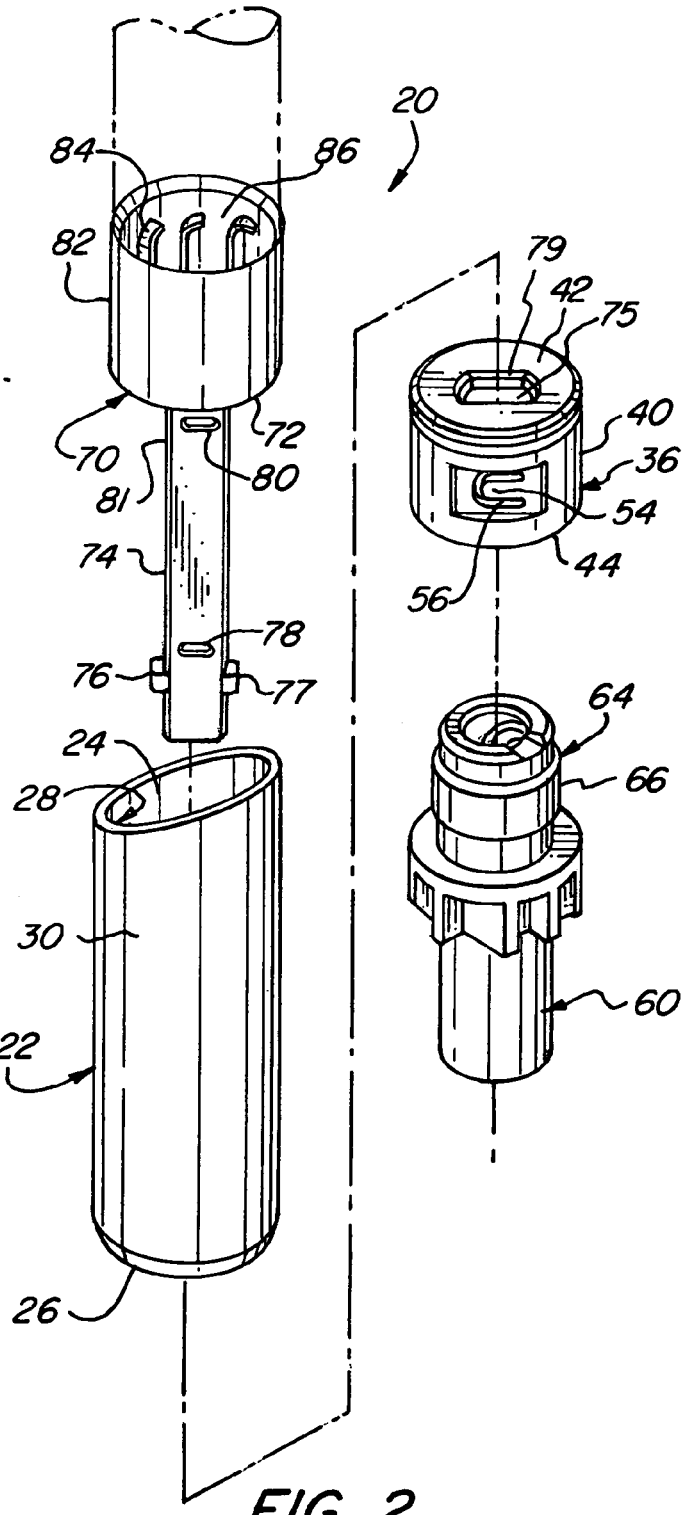
FIG. 2 is an exploded perspective view of the dispenser of FIG. 1.

Referring to FIGS. 1-4, a stick dispenser is shown generally at 20. The dispenser preferably will comprises four pieces, a housing 22, an annular connector 36, an insert 60 and an elevator 70 (see FIG. 2). The pieces may be formed of polymers, either molded, blown or injected, or any other suitable material known in the art.

The longitudinally-extending housing 22 has open upper end 24 and lower end 26, and an inner wall 28 and an outer wall 30. The lower end 26 of the housing 22 has a radially inwardly extending rib 32. The housing 22 may be generally circular in cross-section and the inner wall 28 has a generally smooth surface.

The annular connector 36 has an inner wall 38 and an outer wall 40 and an upper end 42 and an open lower end 44. The upper end 42 of the connector 36 has an annular channel 46 formed in the outer wall 40 such that the radially inwardly extending rib 32 of the housing 22 snap fits within the annular channel 46 to secure the housing 22 and connector 36 together. Alternatively, the housing and the connector may be integrally molded together as a single piece so that the snap fit rib and channel are not required.

Figure 3:
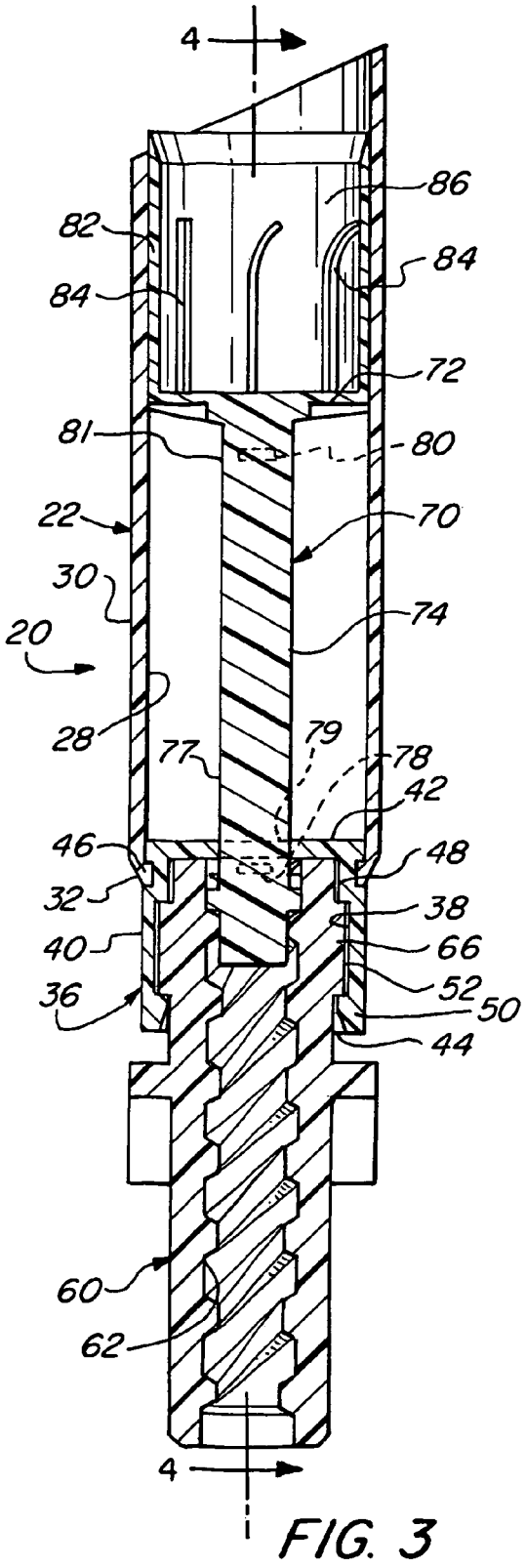
FIG. 3 is a cross-sectional view, taken along section 3 of the dispenser of FIG. 1 in an extended position.
Figure 4:
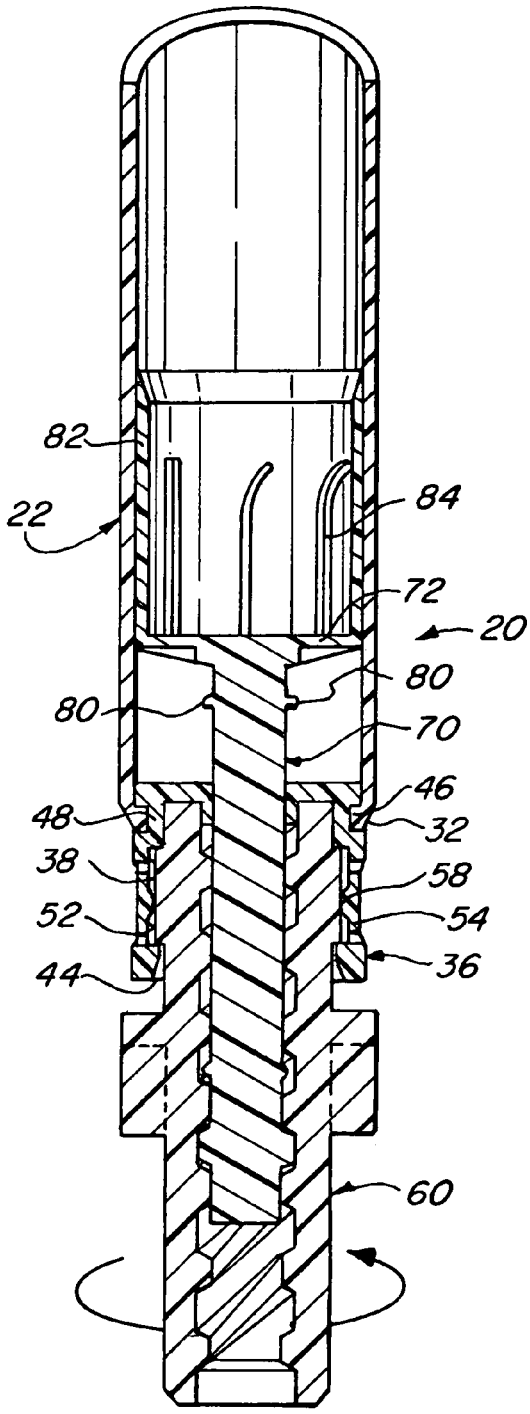
FIG. 4 is a cross-sectional view, taken along section 4 in FIG. 3 of the dispenser of FIG. 1 nearly in a retracted position.

As best seen in FIGS. 3 and 4, the inner wall 38 of the connector has two radially inward extending shoulders, one an upper shoulder 48 at the upper end 42 and a lower shoulder 50 at the lower end 44 forming an inner recess 52 on the inner wall 38 of the connector 36.

The connector 36 also includes a number of cantilevered tabs 54. The cantilevered tabs 54 preferably number two, but three or four may also be used as long as the tabs are generally equally spaced around the circumference of the connector 36. Each cantilevered tab 54 is formed by a C-shaped cut-out 56 through the inner 38 and outer 40 walls of the connector. The cantilevered tabs 54 each also have inwardly facing protrusions 58.

The insert 60 is internally screw threaded 62 on an inner wall. Preferably, the insert is internally left hand screw threaded so that the product may be dispensed by a clockwise rotation of the insert relative to the housing 22. The connector 36 and the insert 60 have mutually engaging means to be secured together. In a preferred embodiment, shown in FIGS. 2 and 7, the insert 60 has an upper end 64 with a radially outwardly extending rib 66 sized to fit within the connector inner recess 52 when the upper end 64 is force fit within the connector 36. As a result, the insert 60 and the connector 36 can be rotatably attached together. Inwardly facing protrusions 58 of the cantilevered tabs 54 may provide drag friction through contact with the radially outwardly extending rib 66 of the insert 60 when assembled. The insert can be assembled to a base member (not shown) to be rotated for dispensing product.

An elevator 70 having a platform 72 adapted to slidingly fit inside the housing 22. In a preferred embodiment, the platform 72 has a cross-sectional shape which corresponds to the cross-sectional shape of the inner wall 28 of the housing 22. A cylinder 82 is positioned on the elevator platform 72 to contain the product to be dispensed. The cylinder may have a plurality of ribs 84 extending from the inner surface 86 of the cylinder. The ribs preferably are biased to extend inwardly towards the center of the cylinder but at an angle which is not perpendicular to the inner surface 86 of the cylinder.

When the product to be dispensed is inserted into the cylinder 82, the plurality of ribs 84 are pressed against the bias towards the inner wall of the cylinder. Due to the bias, the ribs assert a force inwardly towards the center of the cylinder and hold the product securely in place. Over time, the product to be dispensed may lose moisture causing it to shrink and contract from the inner wall of the cylinder. As the product contracts, the ribs 84 move with the bias inwardly and continue to pressure and hold the product in place.

Figure 6:
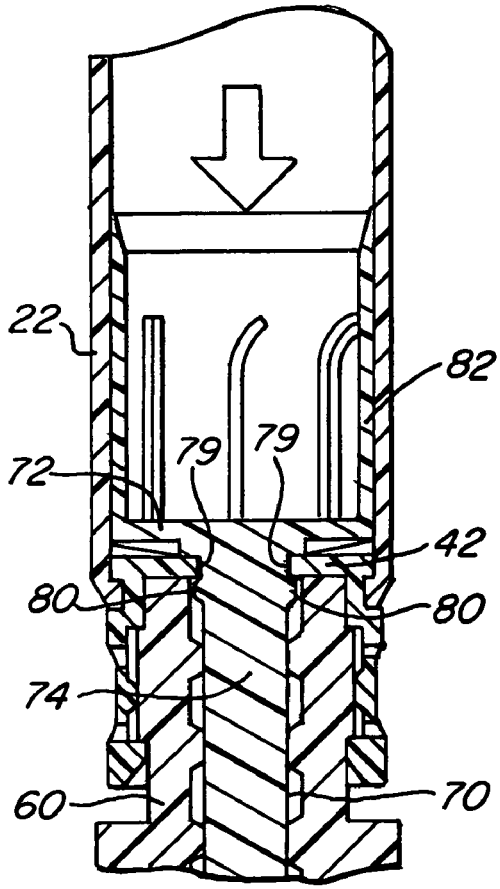
FIG. 6 is a detailed cross-sectional view, taken along section 3 of the dispenser of FIG. 1 in a retracted position.

The elevator also has a stem 74 adapted to the internal screw threads 62 of the insert 60. The stem 74 has a length sufficient to allow the elevator platform 72 to be axially moved from a retracted position (FIG. 6), where the platform is just above the insert 60, to an extended position (FIG. 3), where the platform is generally adjacent the upper open end 24 of the housing 22. The elevator 70 moves within the housing 22 without the need of interaction with the housing. The direct drive system and the smooth inner wall 28 of the housing eliminate the need for threading or tracking for the elevator cylinder. Thus, if some of the product to be dispensed were to escape the cylinder and get between the outside of the cylinder and the inner wall 28 of the housing 22, the mechanism of the dispenser 20 will not be affected.

The stem 74 has a key 76 adapted to the internal screw threads 62 of the insert 60. The stem and the key can be fitted through an opening 75 in the upper end 42 of the connector 36 which is sized to fit the key 76. In a preferred embodiment, the elevator 70 may meet a resistance it must overcome or click past to enter or exit the retracted position. Similarly, in a preferred embodiment, the elevator 70 may meet a resistance it must overcome or click past to enter or exit the extended position.

This resistance may be achieved by providing either a lip or a ridge in the threading of the insert 60 for the key 76 to overcome. It may also be dip or groove, which the key 76 of the stem 74 must similarly pass. The lock at the bottom end will provide a resistance which the key must click past to overcome, locking the elevator in the retracted position. Likewise, the lock at the top end of will provide a the feeling of a notched resistance which the key must click past to overcome, locking the elevator in the extended position.

Figure 5:
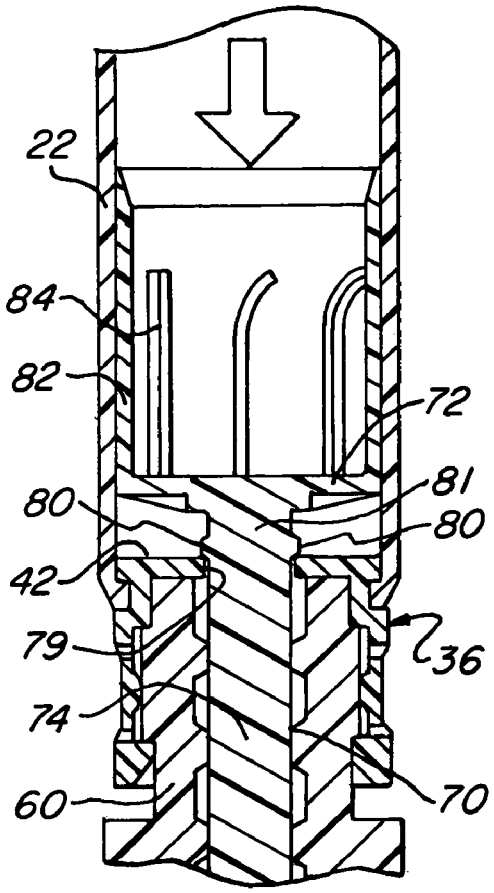
FIG. 5 is a detailed cross-sectional view, taken along section 3 of the dispenser of FIG. 1 nearly in a retracted position.

However, in a preferred embodiment shown in the Figures, the resistance may be caused by a protrusion 78 at a lower end 77 of the stem 74 and by a protrusion 80 at an upper end 81 of the stem. The protrusion 80 on the upper end 81 of the stem 74 will interfere with an edge 79 of the opening 75 in the upper end 42 of the connector 36 providing a resistance which will serve to maintain the elevator 70 in the retracted position. The insert 60 is rotated and the elevator 70 is lowered towards the retracted position as shown in FIG. 5. The resistance provided by the interaction between the protrusion 80 and the edge 79 of the opening 75 will be overcome by the rotation force to set the elevator 70 in the retracted position illustrated in FIG. 6. This feature will help ensure that the product is not inadvertently dispensed while in a purse or makeup bag. Similarly, the protrusion 78 will interfere with an edge 79 of the opening 75 in the upper end 42 of the connector 36 as the elevator 70 enters and exits the extended position illustrated in FIG. 3. When the insert 60 is rotated and the elevator 70 is raised towards the extended position, the resistance provided by the interaction between the protrusion 78 and the edge 79 of the opening 75 will be overcome to set the elevator in the extended position. This function provides a positive feedback to the user that tells the user that the elevator travel is nearly completed and that turning should end. In addition, the resistance provides the benefit and convenience of keeping the product extended during application.

Figure 7:
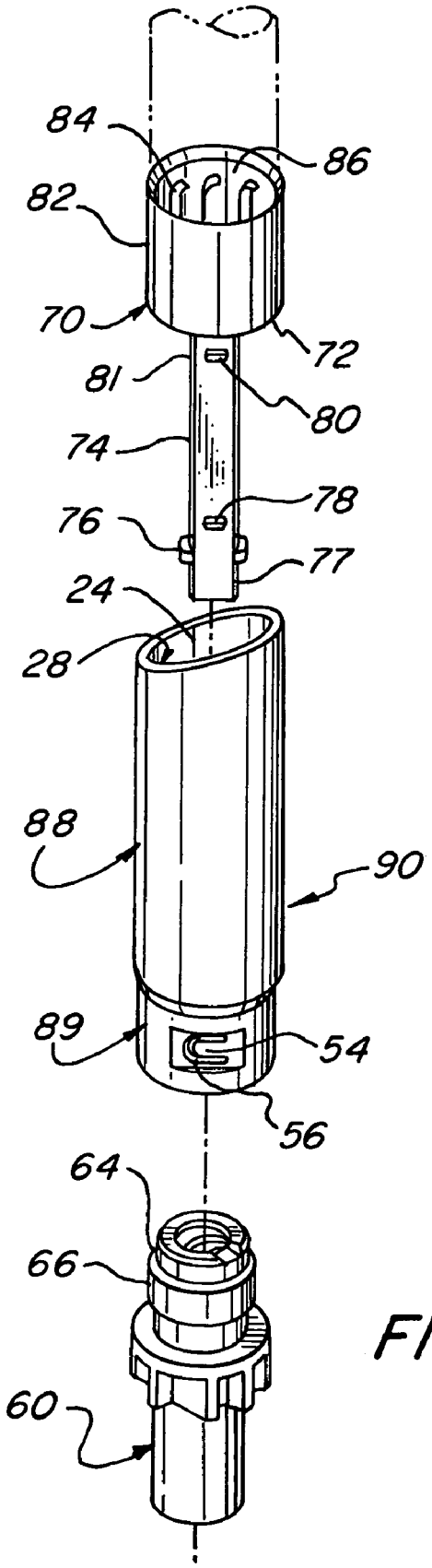
FIG. 7 is an exploded perspective view of an embodiment of the dispenser of FIG. 1.

It is also envisioned that the housing 22 and connector 36 be formed as an integral piece 90 having an upper housing section 88 and a lower connector section 89. In such an embodiment, the dispenser will comprise three pieces polymeric pieces, as illustrated in FIG. 7.

A hollow cap (not shown) may be provided, sized and adapted to surround the housing 22. An A-shell (also not shown) may be applied for aesthetic reasons over the housing. The A-shell may be made of metal or anodized metal.

The preferred embodiment of the dispenser 20 is operable to dispense a product contained in the cylinder 82 of the elevator 70 within the housing 22 by clockwise rotation of the insert 60 relative to the housing 22. The clockwise rotation causes the platform 72 to move axially towards the upper open end 24 of housing 22. Counterclockwise rotation will cause the platform 72 to move axially away from the upper open end 24 of housing 22 and axially towards the upper end of the insert 60.

The steps of assembling the dispenser 20 or the invention are generally as follows. The housing 20 is connected to the annular connector 36. The insert 60 is then snap fit into the lower end of the connector 36. The elevator 70 is slid into the housing 22, stem 74 end first, so that the key 76 passes through the upper end 42 of the connector, and interacts with the internal threads 62 of the insert. The product to be dispensed is inserted into the cylinder 82 of the elevator 70. It is to be appreciated that the dispenser of the invention permits the filling of the cylinder 82 prior to assembly of the elevator 70 with the insert 60.

The invention of the application provides a new and useful dispenser having a slim profile, and also provides a substantial ease and flexibility in the manufacturing and packaging of a stick product such as lipstick. A particular advantage of the described invention is that it allows for smooth interior walls in the housing 22, which is an advantage with newer softer lipstick pomades, because the smooth wall avoids problems of lipstick pomade becoming extruded into and gumming up the extend/retract mechanism of the dispenser. Use of lubricants which can alter or damage the lipstick pomade can also be avoided by the present invention particularly where the connector is fabricated from acetyl and the housing is fabricated from ABS plastic.

What is claimed is:

1. A dispenser comprising:

a longitudinally-extending housing having open upper and lower ends, and inner and outer walls;

an annular connector, said connector having an inner wall and an outer wall and an upper and a lower end, said inner wall having radially inward extending shoulders at the upper end and lower end forming an inner recess therein, at least two cantilevered tabs, each cantilevered tab formed by a C-shaped cut-out through the inner and outer walls of said connector, said connector and said housing having a mutually interfitting annular channel and an annular rib to secure said housing and connector together;

an insert, said insert being internally screw threaded and having an upper end with a radially outwardly extending rib sized to fit within the inner recess of said connector when said upper end of said insert is force fit within said connector such that said insert and said connector are rotatably connected and said cantilevered tabs provide drag friction; and an elevator, said elevator comprising a platform adapted to slidingly fit inside said housing, and a stem, passing through an opening in the upper end of said connector and adapted to the internal screw threads of said insert, said stem having a length sufficient to allow said elevator platform to be axially moved from a retracted position wherein said platform is in close proximity to the upper end of the insert to an extended position wherein said platform is generally adjacent the upper open end of said housing.

2. A dispenser according to claim 1, wherein, said dispenser comprises four molded polymeric pieces, wherein, said housing is one piece, said connector is another piece, said insert is another piece, and said elevator is another piece.

3. A dispenser in accordance with claim 1, wherein said cantilevered tabs further comprise inwardly facing protrusions which contact the radially outwardly extending rib of said insert when assembled to provide drag friction.

4. A dispenser in accordance with claim 1, wherein, said elevator platform comprises an outer surface and the inner wall of said housing and the outer surface of said elevator platform are generally the same cross-sectional shape.

5. A dispenser in accordance with claim 1, wherein, the inner wall of said housing comprises a smooth surface.

6. A dispenser in accordance with claim 1, wherein, said stem comprises a key adapted to the internal screw threads of said insert.

7. A dispenser according to claim 6, wherein, the opening in the upper end of said connector is sized to the key of said stem.

8. A dispenser according to claim 6, wherein, said elevator overcomes a resistance before entering or being extended from the retracted position.

9. A dispenser according to claim 8, wherein, the resistance is caused by a protrusion at an upper end of said stem, the protrusion interacting with an edge of the opening in the upper end of said connector as said elevator enters and exits the retracted position.

10. A dispenser according to claim 6, wherein, said elevator overcomes a resistance before entering or being retracted from the extended position.

11. A dispenser according to claim 10, wherein, the resistance is caused by a protrusion at a lower end of said stem, the protrusion interacting with an edge of the opening in the upper end of said connector as said elevator enters and exits the extended position.

12. A dispenser in accordance with claim 1, wherein, said elevator further comprises a cylinder positioned on the elevator platform to contain a product to be dispensed.

13. A dispenser in accordance with claim 12, wherein, said cylinder comprises a plurality of ribs to secure the product to be dispensed.

14. A dispenser in accordance with claim 13, wherein said plurality of ribs are biased to extend inwardly at an angle not perpendicular from an inner surface of the cylinder.

15. A dispenser in accordance with claim 14, wherein, said plurality of ribs are pressed against the bias by the insertion of the product to be dispensed to secure the product to be dispensed within said cylinder.

16. A dispenser in accordance with claim 15, wherein, said plurality of ribs will move with the bias to secure the product to be dispensed within said cylinder as the product to be dispensed contracts over time.

17. A dispenser comprising:

a longitudinally-extending housing comprising an upper housing portion and a lower connector portion;

the upper housing portion comprising an open upper end and inner and outer walls;

the lower connector portion comprising:

an inner wall and an outer wall and an upper end and an open lower end, the inner wall having radially inward extending shoulders at the upper end and lower end forming an inner recess therein;

at least two cantilevered tabs, each cantilevered tab formed by a C-shaped cut-out through the inner and outer walls of the lower connector portion;

an insert, said insert being internally screw threaded and having an upper end with a radially outwardly extending rib sized to fit within the lower connector portion inner recess when the upper end of said insert is force fit within said connector such that said insert and said connector are rotatably connected and said cantilevered tabs provide drag friction; and an elevator, said elevator comprising a platform adapted to slid ingly fit inside the upper housing portion, and a stem, passing through an opening in the upper end of the lower connector portion and adapted to the internal screw threads of said insert, said stem having a length sufficient to allow said elevator platform to be axially moved from a retracted position wherein said platform is in close proximity to the upper end of the insert to an extended position wherein said platform is generally adjacent the upper open end of said upper housing portion.

18. A dispenser in accordance with claim 17, wherein said cantilevered tabs further comprise inwardly facing protrusions which contact the radially outwardly extending rib of said insert when assembled to provide drag friction.

19. A dispenser in accordance with claim 17, wherein, said stem comprises a key adapted to the internal screw threads of said insert.

20. A dispenser according to claim 19, wherein, the opening in the upper end of said lower connector portion of said housing is sized to the key of said stem.

21. A dispenser according to claim 19, wherein, said elevator overcomes a resistance when being extended from the retracted position.

22. A dispenser according to claim 21, wherein, the resistance is caused by a protrusion at a upper end of said stem, the protrusion interacting with an edge of the opening in the upper end of said lower connector portion of said housing as said elevator axially enters and exits the retracted position.

23. A dispenser according to claim 19, wherein, said elevator overcomes a resistance when being retracted from the extended position.

24. A dispenser according to claim 23, wherein, the resistance is caused by a protrusion at an lower end of said stem, the protrusion interacting with an edge of the opening in the upper end of said lower connector portion of said housing as said elevator enters and exits the extended position.

25. A dispenser in accordance with claim 17, wherein, said elevator further comprises a cylinder positioned on the elevator platform to contain the product to be dispensed.

26. A dispenser in accordance with claim 25, wherein, said cylinder comprises a plurality of ribs biased to extend inwardly at an angle not perpendicular from an inner surface of the cylinder and said plurality of ribs are pressed against the bias by the insertion of a product to be dispensed to secure the product within said cylinder and said ribs will move with the bias to secure the product within said cylinder as the product contracts over time.

27. A dispenser in accordance with claim 17, wherein, said housing and said connector are formed as an integral piece.

28. A dispenser in accordance with claim 27, wherein, said dispenser comprises three molded polymeric pieces, wherein, said integral housing and connector is one piece, said insert is another piece and said elevator is another piece.

29. A dispenser comprising:

a longitudinally-extending housing having open upper and lower ends, and inner and outer walls, said lower end of said housing having a radially inwardly extending rib and said inner wall comprising a smooth surface;

an annular connector, said connector having an inner wall and an outer wall and an upper and a lower end, with an opening in the upper end;

the upper end having an annular channel formed in the outer wall such that the radially inwardly extending rib of said housing snap fits within the annular channel to secure said housing and connector together;

said inner wall having radially inward extending shoulders at the upper end and lower end forming an inner recess therein;

at least two cantilevered tabs, each cantilevered tab formed by a C-shaped cut-out through the inner and outer walls of said connector and comprise inwardly facing protrusions;

an insert, said insert being internally screw threaded and having an upper end with a radially outwardly extending rib sized to fit within the inner recess of said connector when said upper end of said insert is force fit within said connector such that said insert and said connector are rotatably connected and said at least two cantilevered tabs provide drag friction where the inwardly facing protrusions of said at least two cantilevered tabs contact the radially outwardly extending rib of said insert when assembled;

an elevator, said elevator comprising a platform adapted to slidingly fit inside said housing, said elevator platform comprising an outer surface of generally the same cross-sectional shape of the inner wall of said housing, and a stem comprising a key adapted to the internal screw threads of said insert, the key passing through the opening in the upper end of said connector, and said stem having a length sufficient to allow said elevator platform to be axially moved from a retracted position wherein said platform is generally adjacent said insert to an extended position wherein said platform is generally adjacent the upper open end of said housing; and said elevator further comprising a cylinder positioned on the elevator platform to contain a material to be dispensed, said cylinder comprises a plurality of ribs biased to extend inwardly at an angle not perpendicular from an inner surface of the cylinder such that the plurality of ribs are pressed against the bias by the insertion of the material to be dispensed to secure the material to be dispensed within said cylinder and the plurality of ribs will move with the bias to secure the material to be dispensed within said cylinder as the material to be dispensed contracts over time.

* * * * *